US010731852B2

(12) United States Patent
Paras

(10) Patent No.: US 10,731,852 B2
(45) Date of Patent: Aug. 4, 2020

(54) INCINERATOR

(71) Applicant: NOBULLIM, LLC, Upper Sandusky, OH (US)

(72) Inventor: Thomas G. Paras, Upper Sandusky, OH (US)

(73) Assignee: NOBULLIM, LLC, Upper Sandusky, OH (US)

( * ) Notice: Subject to any disclaimer, the term of this patent is extended or adjusted under 35 U.S.C. 154(b) by 112 days.

(21) Appl. No.: 16/051,752

(22) Filed: Aug. 1, 2018

(65) Prior Publication Data

US 2019/0041057 A1 Feb. 7, 2019

Related U.S. Application Data

(60) Provisional application No. 62/540,179, filed on Aug. 2, 2017.

(51) Int. Cl.

| | |
|---|---|
| ***F23G 5/44*** | (2006.01) |
| ***F23G 5/40*** | (2006.01) |
| ***F23L 1/02*** | (2006.01) |
| ***F24B 1/02*** | (2006.01) |
| ***F23G 5/50*** | (2006.01) |

(52) U.S. Cl.

CPC ..... *F23G 5/44* (2013.01); *F23G 5/40* (2013.01); *F23L 1/02* (2013.01); *F24B 1/02* (2013.01); *F23G 5/50* (2013.01); *F23G 2203/401* (2013.01)

(58) Field of Classification Search

CPC ..... F23G 5/40; F23G 5/42

See application file for complete search history.

(56) References Cited

U.S. PATENT DOCUMENTS 1,692,448 A * 11/1928 Jones ..... F23G 5/002 110/235

3,482,532 A * 12/1969 St Cyr ..... F23G 5/00 110/212

(Continued)

FOREIGN PATENT DOCUMENTS

| | | |
|---|---|---|
| CH | 579237 A | 8/1976 |
| KR | 101576926 B1 | 12/2015 |
| WO | 20070277808 A1 | 5/2012 |

OTHER PUBLICATIONS

Hafele, Casement Window Fittings, TCH-AI 2008, HUK, Section 7, p. 5, downloaded from Internet; https://www.locksonline.com/docs/pdf/09A7-5.PDF.

*Primary Examiner* — David J Laux

(74) *Attorney, Agent, or Firm* — Jacob M. Ward; Ward Law Office LLC

(57) ABSTRACT

An incinerator has a hollow main body with a front wall, a rear wall, a first side wall, a second side wall, a top wall, and a bottom wall. The front wall has a first opening and a second opening formed therein. The second opening is disposed adjacent to the bottom wall between the first opening and the bottom wall. The rear wall has at least one inlet aperture formed adjacent to the bottom wall. The first side wall and the second side wall each have at least one outlet aperture disposed adjacent to the top wall. The incinerator further has a door that is movable between an opened position, whereby waste may be disposed on a grate suspended inside of the main body, and a closed position, whereby the door may cover the first opening.

20 Claims, 7 Drawing Sheets

(56) References Cited

U.S. PATENT DOCUMENTS

| | | | | |
|---|---|---|---|---|
| 4,499,889 | A * | 2/1985 | Syme | F24B 5/02 126/75 |
| 5,375,540 | A * | 12/1994 | Verrecchia | F23B 1/22 110/255 |
| 2007/0272226 | A1* | 11/2007 | Hustad | F23B 5/02 126/77 |
| 2007/0277808 | A1* | 12/2007 | Bean | F23G 5/245 126/307 R |
| 2014/0261374 | A1* | 9/2014 | Lubanowski | F23G 5/40 126/224 |

* cited by examiner

INCINERATOR

CROSS-REFERENCE TO RELATED APPLICATIONS

This application claims the benefit of U.S. Provisional Application Ser. No. 62/540,179, filed on Aug. 2, 2017. The entire disclosure of the above application is hereby incorporated herein by reference.

FIELD

The present disclosure relates to a waste disposal system and, more particularly, to an incinerator for waste.

BACKGROUND

The disposal of waste is a major concern of the municipal, commercial, and private sectors. Various types of recycling equipment and techniques are in use or have been proposed to dispose of waste, all with varying degrees of success.

One known method of disposal is to transport and bury the waste in a landfill. However, landfill sites are becoming scarce. Those remaining landfills are cost prohibitive, especially in rapidly growing urban areas. In addition, even if suitable sites for new landfills can be found, they are often at a distance that makes transportation costs prohibitive to their use.

Furthermore, landfills are a relatively inefficient method of recycling. Being simply buried at one site, the economic potential of the land is rarely fulfilled. Therefore, there is a need for an alternative disposal process capable of removing waste while saving land for future development.

One known option for circumventing the use of landfills has been to burn the waste material. However, this produces an ash residue, which can be toxic to the surrounding environment. As a result, there are many environmental limitations imposed by Federal, State, and local jurisdictions, where open burning is not always feasible or possible. Many such regulations significantly limit the amount of ash and smoke that may be released into the atmosphere.

There is a continuing need for an incinerator that is a closed system in compliance with relevant laws and regulations. Desirably, the incinerator is configured to combust waste with minimal emission of ash and debris.

SUMMARY

In concordance with the instant disclosure, an incinerator that is a closed system in compliance with relevant laws and regulations, and which is configured to combust waste with minimal emission of ash and debris, has been surprisingly discovered.

In one embodiment, the incinerator has a hollow main body with a front wall, a rear wall, a first side wall, a second side wall, a top wall, and a bottom wall. The front wall has a first opening and a second opening. The second opening formed in the front wall is adjacent to the bottom wall between the first opening and the bottom wall. The rear wall has at least one inlet aperture formed adjacent to the bottom wall. The first side wall and the second side wall each have at least one outlet aperture adjacent to the top wall. A door is movably disposed on the front wall adjacent to the first opening. The door is movable between an opened position and a closed position. The first opening is uncovered by the door in the opened position, and the first opening is covered by the door in the closed position. A grate is also disposed in the hollow main body between the first opening and the second opening.

In another embodiment, the incinerator has a hollow main body with a front wall, a rear wall, a first side wall, a second side wall, a top wall, and a bottom wall. The front wall has a first opening and a second opening. The second opening formed in the front wall is adjacent to the bottom wall between the first opening and the bottom wall. The rear wall has at least one inlet aperture formed adjacent to the bottom wall. The first side wall and the second side wall each have at least one outlet aperture adjacent to the top wall. The at least one inlet aperture defining a first aperture area and the at least one outlet aperture defining a second aperture area, the first aperture area being greater than the second aperture area. A latch is rotatably affixed to the front wall of the main body adjacent to the first opening. A door is movably disposed on the front wall adjacent to the first opening. The door is movable between an opened position and a closed position. The first opening is uncovered by the door in the opened position, and the first opening is covered by the door in the closed position. Additionally, the door has a wedge formed on an outer surface of the door. The wedge has an angled surface configured to cooperate with the latch disposed on the front wall to selectively secure the door in the closed position. A grate is also disposed in the hollow main body between the first opening and the second opening in the front wall.

In a further embodiment, a method of incinerating waste includes a first step of providing an incinerator. The incinerator has a hollow main body with a front wall, a rear wall, a first side wall, a second side wall, a top wall, and a bottom wall. The front wall has a first opening and a second opening. The second opening formed in the front wall is adjacent to the bottom wall between the first opening and the bottom wall. The rear wall has at least one inlet aperture formed adjacent to the bottom wall. The first side wall and the second side wall each have at least one outlet aperture adjacent to the top wall. A door movably disposed on the front wall adjacent to the first opening. The door is movable between an opened position and a closed position. The first opening uncovered by the door in the opened position, and the first opening covered by the door in the closed position. A grate is also disposed in the hollow main body between the first opening and the second opening in the front wall. A second step of placing waste on the grate. A third step of incinerating the waste. In a further embodiment, the incinerator is either placed in a prevailing wind, or a blower is attached to the at least one of the apertures, both of which increase airflow into the main body.

In an exemplary embodiment, the incinerator is a self-contained burning unit able to burn any kind of waste, trash, or refuse. The unit is designed for both commercial and residential applications. These units are composed of 304L, 14-gauge stainless steel. The door hinges and latch assemblies are also stainless steel. The 304L stainless steel has a very high corrosion resistance suitable for use in incineration of waste. These incinerators are designed to last for many trouble-free years of operation.

The Environmental Protection Agency (EPA) has stipulated that no waste can be burnt using an "open burning" system, which is any device that lacks a sealed chimney or stack. The incinerator of the present disclosure is manufactured with a sealed chimney to comply with EPA regulations. The sealed chimney allows for usage of the incinerator in both rural and urban settings.

It should be appreciated that the incinerator is not meant to replace normal household recycling practices. These units are created to replace costly shredding and disposal services that destroy private information for businesses and consumers. Also, a large advantage of the incinerator is to keep millions of tons of waste out of landfills, collectively.

The interior of the incinerator has a heavy-duty grate to support the items that will be incinerated. The grate is made of a pair of one-half (½) inch overlaying layers of rebar producing one (1) inch of high quality steel, which can withstand many cycles of long lasting incineration. The grate is located in the specialized fire chamber within the incinerator. The fire chamber can withstand the high temperatures associated with the incineration process.

The incinerator further has a door that opens to allow the user to place the waste on the heavy-duty grate. Under the metal grate is a lower ash clean-out area. The ash cleaning area can be a removable tray, box, or simply empty space that allows the ashes to be collected periodically. The ash cleaning area prevents the ashes from building up and interfering with the burning process.

Affixed to the fire chamber is a sealed chimney. The sealed chimney allows the incinerated white smoke to exit the incinerator.

Furthermore, the incinerator does not require electricity or battery power. The units are designed to harness natural airflow. The rear of the incinerator unit can be oriented to face a prevailing wind. Natural air enters into the back of the unit just above the fire chamber, thereby increasing the intensity of the flame and creating lower emissions than the open burning systems known in the art. It has been found that the greater the wind speed, the cleaner the burn. That understood, it has also been found that the units still can be used for incineration and perform well with little to no wind. Without being bound to any particular theory, it is believed the igniting of the waste on the grate may create a positive airflow into the fire chamber through the inlets in the rear of the incinerator unit even in the absence of the prevailing wind.

Moreover, the incinerator operations are not affected by weather or open to animal invasion, unlike conventional open burning systems such as burn barrels, cage style burn pits, etc. Animal invasion can lead to dangerous conditions for family members and pets. The incinerator units of the present disclosure require minimal maintenance, which further advantageously lowers costs for the homeowner.

In an alternate embodiment, a self-contained burning unit used to burn waste or trash, and designed for use in residential and commercial applications, may be manufactured from high strength, crack resistant concrete instead of steel. The incinerators can be made from one continuous concrete pour to ensure uniformity and strength. The interior of the incinerator has a heavy-duty grate to support the items that will be destroyed. The grate can be made of metal, stone, or any other heat retardant material. The grate is located in the reinforced fire chamber. The reinforced fire chamber is capable of withstanding high temperatures. The reinforced fire chamber is where the fuel is burned, destroying the waste. The reinforced fire chamber has a sealable door that is capable of withstanding high temperatures. The door opens to allow a user to place waste on the heavy-duty grate. Under the metal grate is a lower ash cleaning area. The ash cleaning area can be a removable tray, box or simply empty space that allows the ashes to collect. The ash cleaning area prevents the ashes from building up and interfering with the burning process. Affixed to the reinforced fire chamber is a sealed chimney. The sealed chimney allows the debris to exit the incinerator.

DRAWINGS

The above, as well as other advantages of the present invention, will become clear to those skilled in the art from the following detailed description of a preferred embodiment when considered in the light of the accompanying drawings in which.

DETAILED DESCRIPTION

Figure 1:
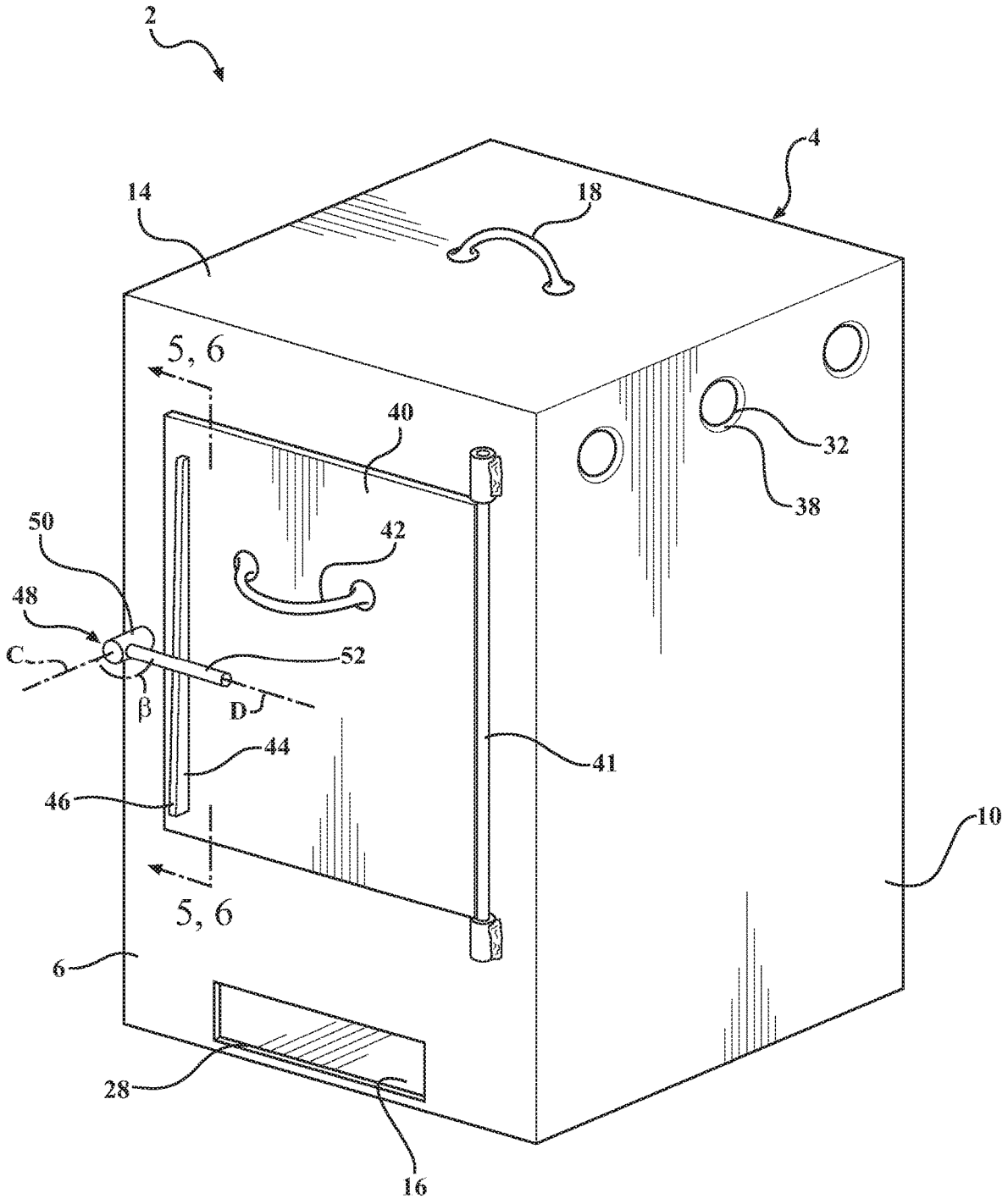
FIG. 1 is a right side, top front perspective view of an incinerator according to one embodiment of the present disclosure, the incinerator shown with a door closed and a latch in a latched position.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical unless otherwise disclosed.

An incinerator 2 according to various embodiments of the disclosure is shown in FIGS. 1-8. The incinerator 2 has a main body 4 with a front wall 6, a rear wall 8, a first side wall 10, a second side wall 12, a top wall 14, and a bottom wall 16. It should be appreciated that although the incinerator 2 is shown as being substantially cuboidal in shape, the incinerator 2 may be any shape as chosen by one skilled in the art. For example, the incinerator 2 may be cylindrical (not shown) where the front wall 6, the rear wall 8, the first side wall 10, and the second side wall 12 are all sections of a single continuous or uninterrupted wall.

It should also be appreciated that the incinerator 2 of the present disclosure is scalable in size and volume, as desired. In certain embodiments, the incinerator 2 may be portable, and have a handle 18 attached to the top wall 14 to facilitate transport, for example, by crane or the hook of a backhoe.

In other embodiments, the incinerator 2 may be provided with rollers (not shown) that may facilitate both the portability and the ability to easily modify an orientation of the incinerator 2, which orientation is described further hereinbelow. Other suitable means for transport and orientation of the incinerator 2 may also be employed, as desired.

In particular embodiments, the incinerator 2 is configured to combust waste 20 using the inherent incendiary properties of the waste 20. The incinerator 2 is also configured to use a combustible fuel, including natural gas, coal, wood, and alcohol as non-limiting examples.

The main body 4 may be manufactured from a heat resistant material and with dimensions that permit the main body 4 to maintain its structural integrity under temperatures associated with the incineration of waste. Suitable materials and dimensions are configured to withstand incineration temperatures between 750° F. and 2,500° F., for example. Examples of suitable materials may include steel, titanium, galvanized metal, and concrete. In a most particular embodiment the main body 4 is manufactured using 304L, 14-gauge stainless steel. It should be appreciated that this steel type and thickness is particularly suitable for use in the manufacture of the main body 4 due to its exemplary fire retardant and anticorrosive properties.

Figure 4:
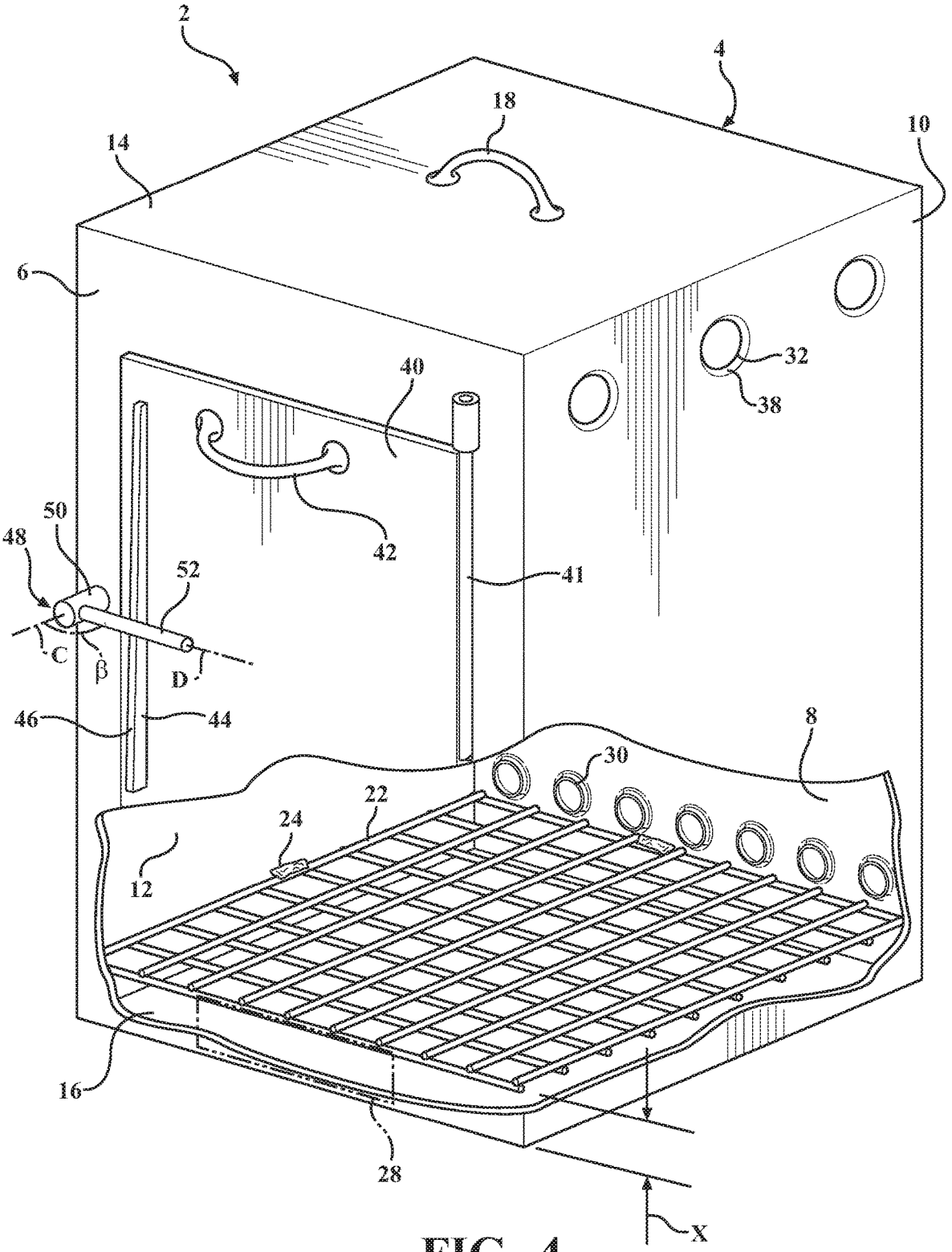
FIG. 4 is partial, top front perspective view of the incinerator shown in FIG. 1, with portions of a front wall and a side wall removed to illustrate an interior of the incinerator.
Figure 8:
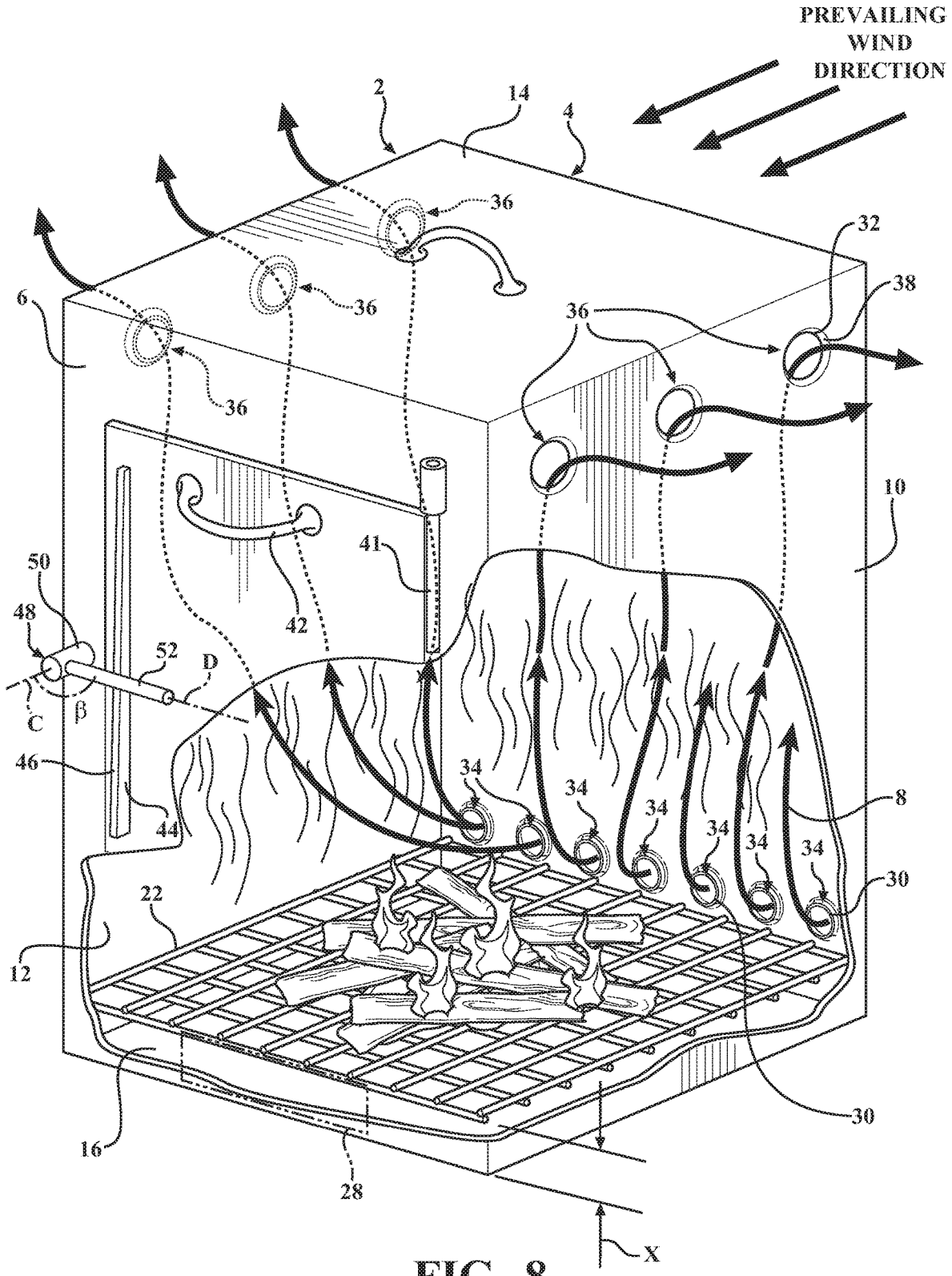
FIG. 8 is partial, top front perspective view of the incinerator shown FIGS. 1-7, and further shown illustrating the interior of the incinerator during a waste burning operation, with the flow of air through the incinerator identified by the arrowed lines.

As shown in FIGS. 4 and 8, a grate 22 is suspended inside of the main body 4. The grate 2 is configured to support the waste 20 as it is incinerated. The grate 22 may abut the front wall 6, the rear wall 8, the first side wall 10, and the second side wall 12. In particular embodiments, the grate 22 may be welded with tack welds 24 to the main body. Most particularly, the grate 22 may be welded with the tack welds 24 to each of the front wall 6, the rear wall 8, the first side wall 10 and the second side wall 12 in order to suspend the grate 22 within the main body 4. However, the grate 22 may be secured within the main body 4 though any other suitable means chosen by one skilled in the art, as desired.

As the waste 20 is combusted, as shown in FIG. 8, remaining uncombusted ash and debris fall through the grate 22, militating against the ash suffocating the fire. In particular, the grate 22 when suspended within the main body 4 may be vertically spaced apart from the bottom wall 16 a suitable distance X to ensure the combusting waste receives sufficient oxygen for the incineration process, and also that the remaining uncombusted ash and debris may be subsequently removed from the incinerator 2 by the operator. As a non-limiting example, the distance X may be at least about three (3) inches between the grate 22 and the bottom wall 16. One of ordinary skill in the art may also select other suitable distances X for the suspended grate 22 within the scope of the disclosure.

The grate 22 may be made of any heat resistant material. As a non-limiting example, the grate 22 may be formed from rebar. In general, rebar is a steel bar or mesh of steel wires that is conventionally used as a tension device in reinforced concrete and reinforced masonry structures to strengthen and hold the concrete in compression. The use of rebar has been found especially suitable for the grate 22 of the disclosure. In a most particular embodiment, the grate 22 may be manufactured from a rebar lattice having one-half (½) inch diameter steel bars or rods that overlap one another. The lattice may have square holes of about one (1) inch per side, for example. Other types and configurations of the grate 22 including hole sizes may also be employed, as desired.

Figure 2:
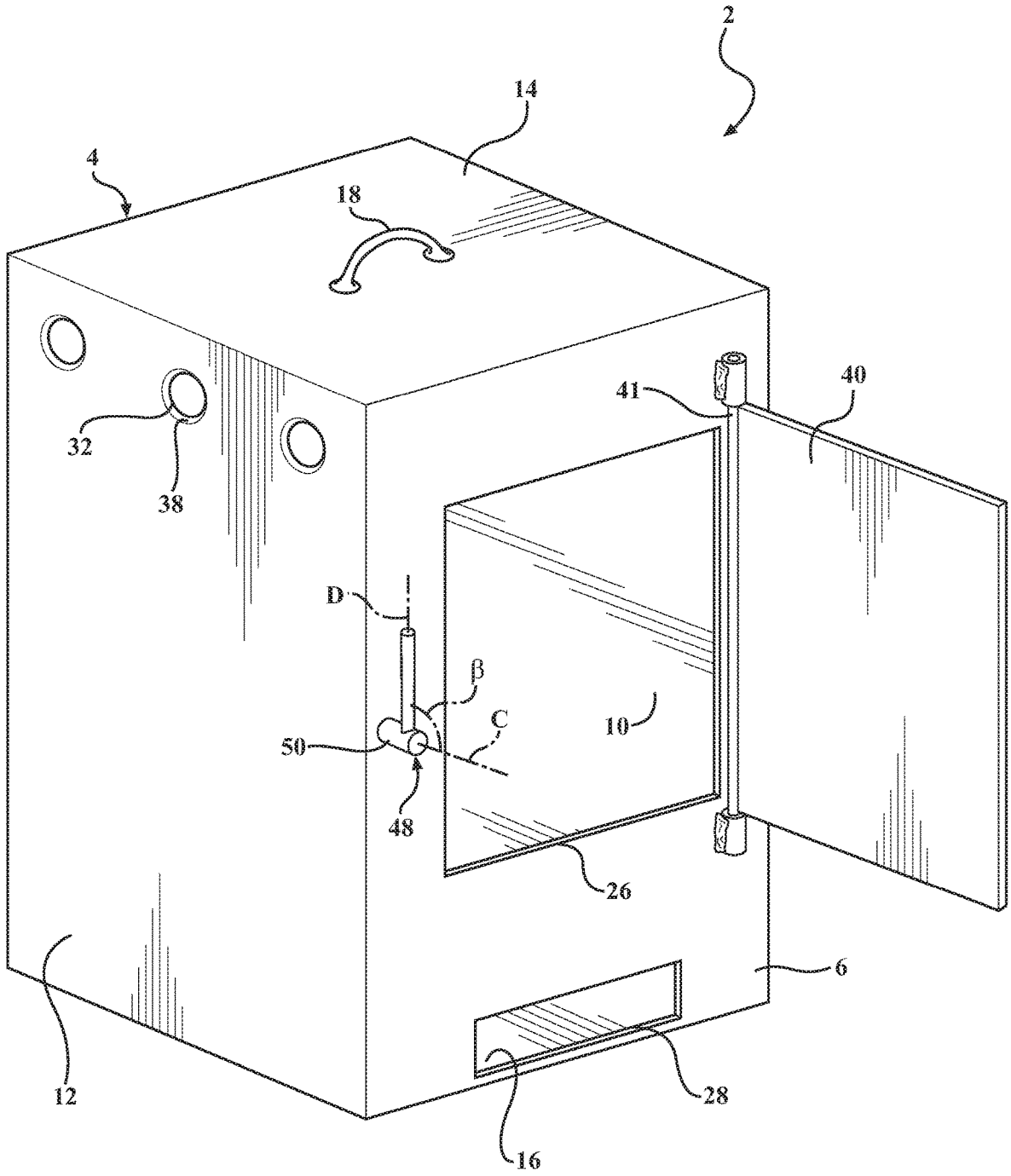
FIG. 2 is a left side, top front perspective view of the incinerator shown in FIG. 1, the incinerator shown with the door opened and the latch in an unlatched position.
Figure 3:
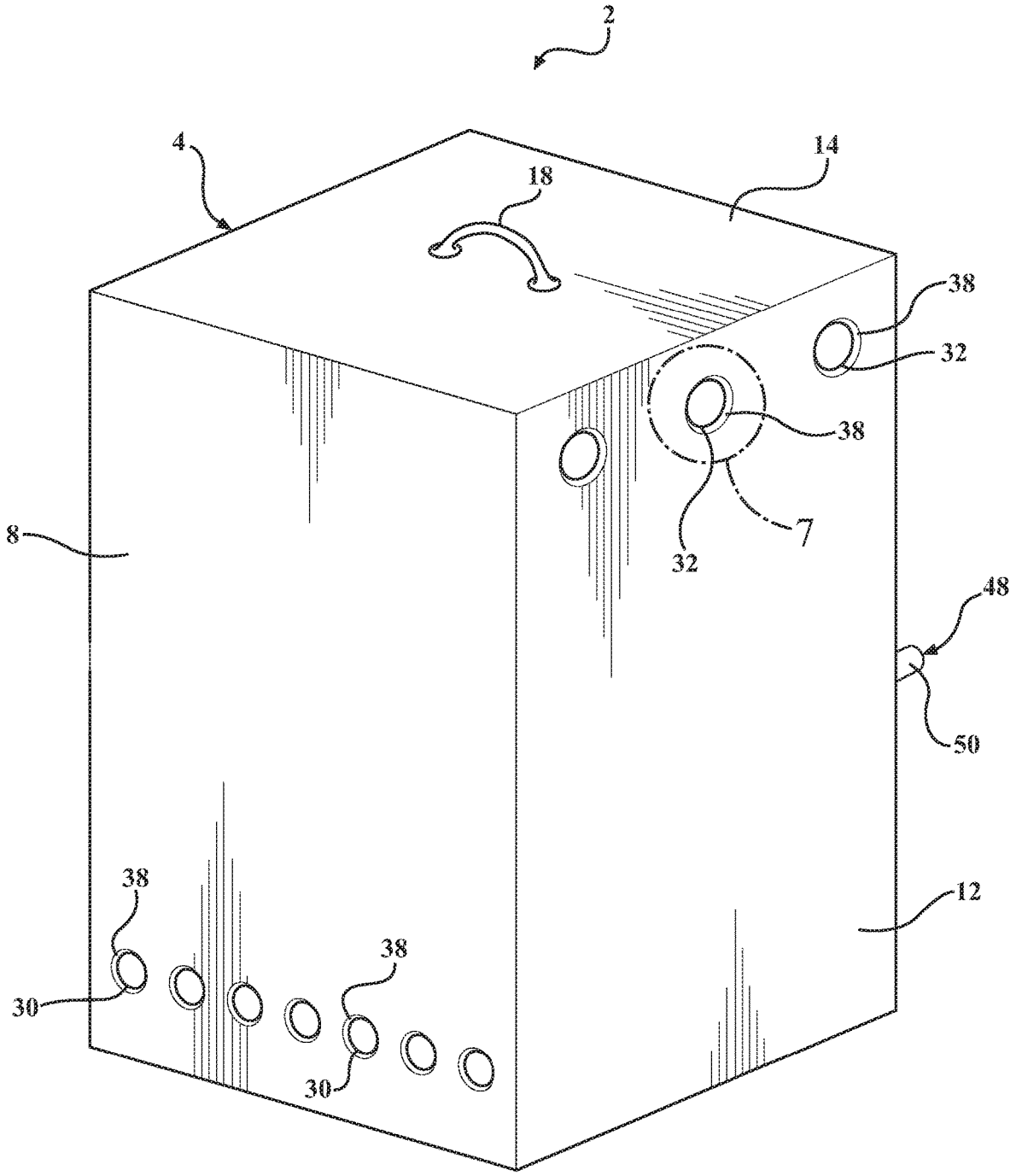
FIG. 3 is a left side, top rear perspective view of the incinerator shown in FIG. 1.

As illustrated in FIGS. 1-3, the front wall 6 has a first opening 26 formed therein. The first opening 26 is adapted to receive the waste 20 for placement on the grate 22. To facilitate the placement of the waste 20 on the grate 22, the first opening 26 is formed in the front wall 6 above the grate 22.

Additionally, the front wall 6 has a second opening 28 that is formed in the front wall 6 below the grate 22. The second opening 28 provides for the removal of the ash and debris from the main body 4. For example, the main body 4 may have empty space disposed below the grate 22 that allows the ash and debris to collect therein, in preparation for subsequent removal by the user, e.g., using a shovel. The space between the grate 22 and bottom wall 16, which may be defined by the distance X, militates against the ash and debris interfering with the burning process. In other embodiments, a removable tray, drawer or box (not shown) may be disposed in the second opening 28 to facilitate the subsequent removal of the ash and debris following the incineration process.

As shown in FIGS. 3, 4 and 8, at least one inlet aperture 30 is formed in the rear wall 8. The at least one inlet aperture 30 may include a plurality of apertures 30. The number and size of the apertures 30 may be adapted to optimize airflow to the incinerator 2. Although certain advantages may be provided by forming the at least one inlet aperture 30 in the rear wall 8 as will be described further hereinbelow, it should be appreciated that the at least one inlet aperture 30 may also be formed on any one of the other walls 6, 10, 12 of the hollow main body 4, as desired.

In a most particular embodiment, the inlet apertures 30 are formed adjacent to the bottom wall 16 of the main body 4 and directly above the grate 22. This placement of the inlet apertures 30 has been found to provide superior airflow during combustion. In particular, the aforementioned location of the inlet apertures 30 above the grate 22 militates against the ash and debris clogging the inlet apertures 30 and inhibiting airflow to the incinerator 2 with continued operation of the incinerator 2.

In operation, where the incinerator 2 is placed at an outdoors location for operation, the at least on inlet aperture 30 may be oriented in a direction facing a prevailing wind at the outdoors location. The airflow from the wind increases the intensity and heat of combustion. In this case, the provision of the at least one inlet aperture 30 in only the rear wall 8 of the incinerator 2, such that the rear wall 8 of the incinerator 2 also faces the direction of the prevailing wind, has been found to be particularly advantageous.

In certain embodiments, the incinerator 2 may be connected to a blower or fan unit (not shown) that forces air through the at least one inlet aperture 30 to increase airflow, thereby increasing intensity of the combustion. The increase in oxygen from the airflow, either by a blower or prevailing wind, creates lower emissions and less ash than an open burning system, by heating the waste 20 at a higher temperature.

With renewed reference to FIGS. 1-4, 7 and 8, the main body 4 also has at least one outlet aperture 32. The at least one outlet aperture 32 may be formed in the first side wall 10 and the second side wall 12 of the main body, for example. The at least one outlet aperture 32 formed in the first side wall 10 and the second side wall 12 may include a plurality of outlet apertures 32. In a particular embodiment, shown in FIG. 8, the outlet apertures 32 may be adjacent to the top wall 14 of the main body 4. One of ordinary skill in the art may also select other suitable locations and numbers for the least one outlet aperture 32 in the hollow main body 4, as desired.

As illustrated in FIGS. 1-4 and 8, the top wall 14 of the incinerator 2 is closed. For example, the top wall 14 may have a substantially uninterrupted surface area that is devoid of apertures or openings. In operation, the uninterrupted surface area of the top wall 14 of the main body 4 is configured to force a flow of fumes, which is otherwise flowing upwardly from the combusting waste, to turn outwardly and through the outlet apertures 32 in the first side wall 10 and the second wall of the main body. This is believed to militate against debris and ash exiting the main body 4 in operation. For example, the ash and debris may collide with the top wall 14 and break apart, or the large pieces of ash fall to the bottom of the main body 4 to be removed through the second opening 28 below the grate 22.

In a further embodiment, the outlet apertures 32 in the first side wall 10 and the second side wall 12 may have a mesh (not shown) covering to militate against larger pieces of ash or debris from exiting the incinerator 2. For example, the mesh may be made of metal or any another heat resistant material. The closed top wall 14 also mitigates the escape of heat, which allows the main body 4 to reach temperatures conducive to the incineration process during combustion. This likewise minimizes the amount of ash and debris produced during the combustion.

In particular embodiments, as shown in FIGS. 1-8, the first side wall 10 and the second sidewall may each have three (3) outlet apertures 32, while the rear wall 8 may have seven (7) inlet apertures 30. For example, the inlet and outlet apertures 30, 32 may each be substantially circular and have an opening diameter of about 0.875 inches. However, it should be appreciated there any other number, sizes, and shapes of the inlet and outlet apertures 30, 32 may as chosen by a skilled artisan, as desired.

It should be appreciated that the inlet apertures 30 together define a first aperture area 34 and the outlet apertures 32 together define a second aperture area 36. In illustrative embodiments, the first aperture area 34 may be greater than the second aperture area 36. The larger first aperture area 34 creates a superior airflow to the interior of the main body 2 to ignite the waste 20, as shown in FIG. 8, while militating against the emission or exiting of ash, debris and heat within the main body 4. It should also be appreciated that the greater the second aperture area 36, the more heat, ash, and debris that will be emitted from the interior of the main body 4 over a given period of time. It should also be appreciated minimizing the size of the individual outlet apertures 32 militates against the release of larger pieces of ash or debris. Thus, minimizing the second aperture area 36 relative to the first aperture area 34 and restricting the airflow out of the incinerator 2 in operation may be preferred for both purposes of optimum incineration and reduction of emissions.

In an alternative example, when the at least one inlet aperture 30 is connected to a blower or fan (not shown), it may not be necessary for the main body 4 to have the first aperture area 34 greater than the second aperture area 36. In this example, the air flow rate or pressure supplied by the blower may overcome any restricted air flow that may be naturally caused by a smaller first aperture area 34.

In a most particular embodiment, the inlet and outlet apertures 30, 32 may be formed using a stamp or punch press. The punch press manufacturing process creates a chamfered edge 38 surrounding the aperture 30, 32. The chamfered edge 38 of the apertures 28, 30 militate against an injury or cutting of a user on an otherwise sharp edge of the aperture 30, 32. The apertures may also be cut from the main body 4 using a laser, water jet cutter, saw y, for example. Further operations to soften the edges of the apertures 30, 32 and militate against injury, such as grinding or the welding of short sections of tubing to the apertures 30, 32, may also be employed within the scope of the present disclosure.

With renewed reference to FIGS. 1, 2, 4 and 8, the front wall 6 may further have a door 40. The door 40 allows a user to selectively cover the first opening 26 of the main body 4. The door 40 may be moved between an opened position, shown in FIG. 2, and a closed position, shown in FIG. 1. The door 40 may have a grip 42 to facilitate the moving of the door 40 between the opened and closed positions. The door 40 may be movably attached to the front wall 6 by a hinge 41, a sliding rail, or any other suitable means chosen by a skilled artisan.

Where the door 40 is in the opened position, the user is permitted to access the first opening 26 and place the waste 20 on the grate 22. Where the door 40 is in the closed position, the door 40 militates against ash and debris from exiting through the first opening 26. It should be appreciated that it is not necessary for the door 40 to form an airtight seal with the front wall 6 of the main body 4.

Figure 5:
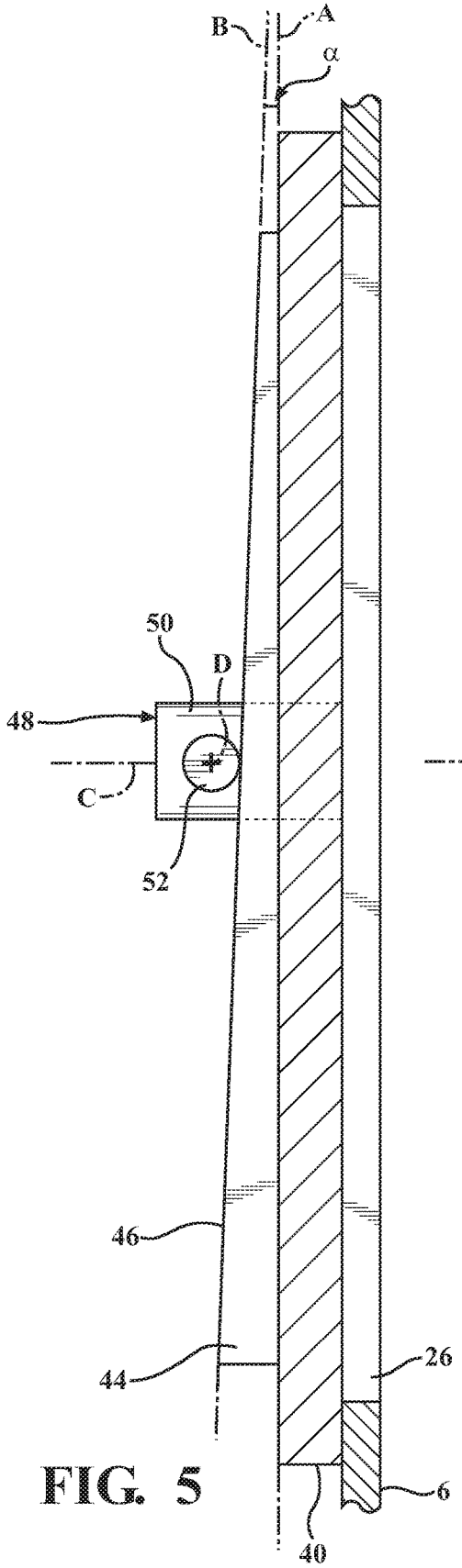
FIG. 5 is a fragmentary, cross-sectional, side elevational view of the door of the incinerator taken at section line 5, 6 in FIG. 1, and further showing the latch in a latched position and abutting a wedge feature of the door to secure the door in a closed position.
Figure 6:
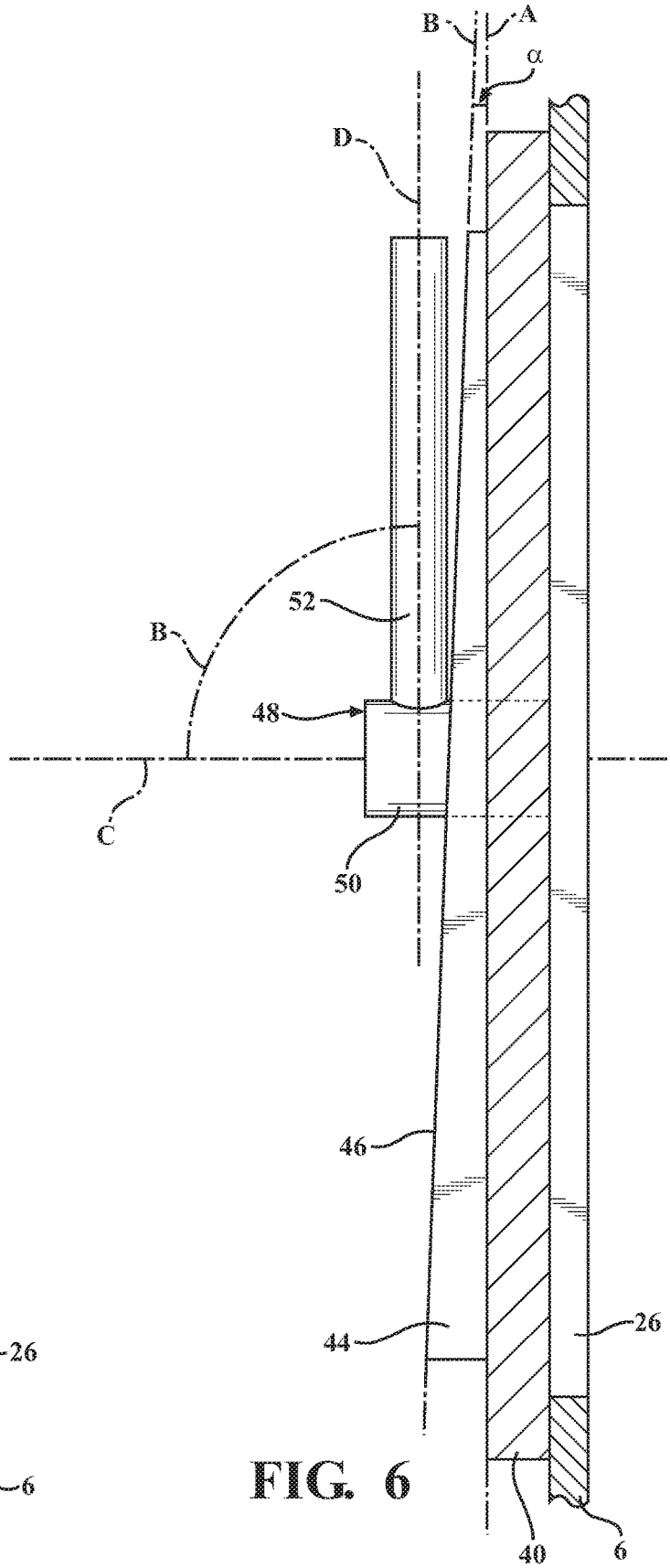
FIG. 6 is a fragmentary, cross-sectional, side elevational view of the door of the incinerator taken at section line 5, 6 in FIG. 1, and further showing the latch in an unlatched position so that the door may be freely moved to an opened position.
Figure 7:
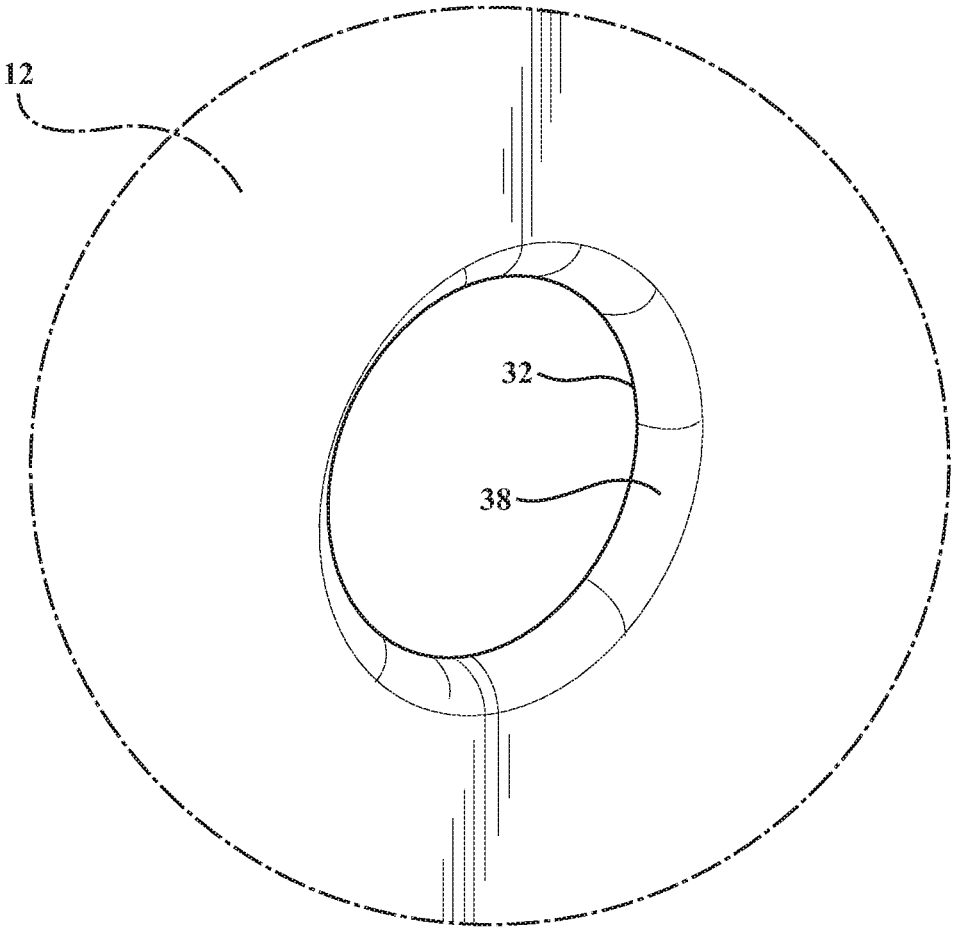
FIG. 7 is a top perspective view of an outlet aperture formed in a side wall of the incinerator and taken at call-out 7 in FIG. 3.

As shown in FIGS. 1, 2, and 4-8, a wedge 44 with an angled surface 46 may be attached to the door 40. In certain embodiments, the door 40 is generally disposed on a plane A, and the angled surface 46 of the wedge 44 is disposed on a plane B, as shown in FIGS. 5 and 6. The plane A is oriented transverse to the plane B at a wedge angle $\alpha$. For example, the wedge angle $\alpha$ may be between about 5 degrees and about 25 degrees. In a particular embodiment, the wedge angle $\alpha$ is between about 10 degrees and about 20 degrees. In a most particular embodiment, the wedge angle $\alpha$ is about 15 degrees. One of ordinary skill in the art may also select other suitable angles for the wedge angle $\alpha$, as desired.

As shown in FIGS. 1, 2, 4-6, and 8, the incinerator 2 may further include a latch 48. The latch 48 may be rotatably attached to the front wall 6. The latch 48 has a connecting portion 50 and an elongate handle portion 52. The connecting portion 50 rotatably attaches the latch 48 to the front wall 6, while the elongate handle portion 52 may be employed as a handle permitting the user to selective move the latch 48 between an unlatched position and a latched position.

As shown in FIGS. 1, 2, 4, and 8, the latch 48 may be turned or rotated about an axis of rotation C. The elongate handle portion 52 of the latch 48 is disposed on an elongate axis D. The elongate axis D is oriented transverse to the axis of rotation C at a handle angle $\beta$. Where the elongate handle portion 52 is in the latched position, the elongate handle portion 52 abuts the angled surface 46 of the wedge 44, and biases the door 40 in the closed position through a spring force applied by the latch 48. Where the elongate handle portion 52 is in the unlatched position, the elongate handle portion 52 is spaced apart from the angled surface 46 of the wedge 44 and the door 40 may be manually opened.

It should be appreciated that the biasing spring force of the latch 48 is provided where the handle angle $\beta$ of the elongate handle portion 52 in the unlatched position is greater than the handle angle $\beta$ of the elongate handle portion 52 in the latched position due to a slightly outward bending of the elongate handle portion 52. In particular, where the elongate handle portion 52 abuts the angled surface 46 of the wedge 44 in the latched position, the handle angle $\beta$ decreases because the elongate handle portion 52 is biased outwardly by the wedge 44. For example, the angle $\beta$ may normally be between approximately 85 degrees and 105 degrees, and more particularly about 95 degrees, when the elongate handle portion 52 is in the unlatched position. However, the handle angle $\beta$ may be between about 80 degrees and 100 degrees, and more particularly about 90 degrees, when the elongate handle portion 52 in the latched position. One of ordinary skill in the art may select other suitable handle angles 13 for biasing the door 40 in the closed position when the latch 48 is in the latched position, as desired.

In operation, as shown in FIG. 8, the user may orient the incinerator 2 so that the inlet apertures 30 generally face a prevailing wind. Facing the inlet apertures 30 toward the prevailing wind increases airflow to the incinerator 2, which is believed to result in a hotter, cleaner incineration. It should be appreciated that, once the incinerator 2 has been oriented appropriately, it may never need to be subsequently moved. However, as described further hereinabove, the incinerator 2 may also be provided with means for a rapid adjustment of the orientation within the scope of the disclosure.

To begin the incineration process, the user may open the door 40 and place the waste 20 on the grate 22. After placing the waste 20 on the grate 22, the user will ignite the waste 20 and close the door 40. It should be appreciated that the waste 20 may also be ignited by other means, for example, the second opening 28 following the moving of the door 40 to the closed position, as desired.

Once the door 40 is moved to the closed position, the user may move the elongate handle portion 52 of the latch 48 from the unlatched position to the latched position where the elongate handle portion 52 is biased against the angled surface 46 of the wedge 44, The elongate handle portion 52 may be held in place by a friction fit with the wedge 44, until the user desires to reopen the door 40 following the incineration process.

As shown in FIG. 8, while the waste 20 burns, ambient air may be drawn into the main body 4 through the inlet apertures 30 near the bottom wall 16 and expelled through the outlet apertures 32 near the top wall 14. The temperature inside the main body 4 rapidly increases, and the waste 20 is consumed by incineration.

During the incineration process, and as described further hereinabove, the closed top wall 14 of the main body 4 militates against excess ash or debris from being expelled or emitted in the surrounding environment. The waste 20 material is then fully combusted producing residual ash and debris. The uncombusted ash and debris may subsequently be removed through the second opening 28 for disposal or repurposing.

In another embodiment, the user may connect the incinerator 2 to a blower (not shown) via the at least one inlet aperture 30. The blower may circulate air into the hollow main body 4, which increases the temperature inside the main body 4, consuming the waste 20 materials.

Advantageously, the incinerator 2 of the present disclosure is a closed system in compliance with relevant laws and regulations. It should be understood that the incinerator 2 as described is configured to combust waste with minimal emission of ash and debris.

While certain representative embodiments and details have been shown for purposes of illustrating the invention, it will be apparent to those skilled in the art that various changes may be made without departing from the scope of the disclosure, which is further described in the following appended claims.

What is claimed is:

1. An incinerator, comprising:

a hollow main body with a front wall, a rear wall, a first side wall, a second side wall, a top wall, and a bottom wall, the front wall having a first opening and a second opening formed therein, the rear wall having at least one inlet aperture formed therein adjacent to the bottom wall, the first side wall and the second side wall each having at least one outlet aperture formed therein adjacent to the top wall;

a door movably disposed on the front wall adjacent to the first opening, the door movable between an opened position and a closed position, the first opening uncovered by the door in the opened position, and the first opening covered by the door in the closed position; and a grate suspended inside of the hollow main body, the grate disposed between the first opening and the second opening in the front wall.

2. The incinerator of claim 1, wherein the at least one inlet aperture defines a first aperture area and the at least one outlet aperture defines a second aperture area, the first aperture area being greater than the second aperture area.

3. The incinerator of claim 2, wherein the at least one inlet aperture includes seven inlet apertures formed in the rear wall and the at least one outlet aperture includes three outlet apertures formed in each of the first side wall and the second side wall.

4. The incinerator of claim 3, wherein each of the inlet apertures and the outlet apertures has an opening diameter of about 0.875 inches.

5. The incinerator of claim 1, wherein the at least one inlet aperture and the at least one outlet aperture are chamfered.

6. The incinerator of claim 1, wherein the hollow main body is made of 304-L grade and 14-gauge stainless steel.

7. The incinerator of claim 1, wherein the grate abuts each of the front wall, the rear wall, the first side wall, and the second side wall.

8. The incinerator of claim 7, wherein the grate is welded with tack welds to each of the front wall, the rear wall, the first side wall and the second side wall.

9. The incinerator of claim 1, wherein the second opening is formed in the front wall adjacent to the bottom wall between the first opening and the bottom wall.

10. The incinerator of claim 1, further comprising a latch disposed on the front wall and configured to selectively bias the door in the closed position.

11. The incinerator of claim 10, the door further having a wedge disposed on an outer surface thereof, the wedge having an angled surface configured to cooperate with the latch to selectively bias the door in the closed position.

12. The incinerator of claim 11, wherein the door is disposed on a first plane and the angled surface of the wedge is disposed on a second plane, the first plane oriented transverse to the second plane and defining a wedge angle therebetween, the wedge angle being between about 5 degrees and about 25 degrees.

13. The incinerator of claim 12, wherein the wedge angle is about 15 degrees.

14. The incinerator of claim 12, wherein the latch is connected to the front wall and selectively movable about an axis of rotation between an unlatched position and a latched position, the latch spaced apart from the wedge where in the unlatched position and the latch abutting the wedge where in the latched position.

15. The incinerator of claim 14, wherein the latch has a wall connecting portion and an elongate handle portion, the elongate handle portion disposed on an elongate axis that is oriented transverse to the axis of rotation and defining a handle angle therebetween.

16. The incinerator of claim 15, wherein the handle angle changes when the latch is in the latched position due to an outward bending of the elongate handle against the angled surface of the wedge, the outward bending providing a spring force to bias the door in the closed position.

17. The incinerator of claim 16, wherein the handle angle is about 95 degrees relative to the axis of rotation where the latch is in the unlatched position, and the handle angle is about 90 degrees relative to the axis of rotation where the latch is in the latched position.

18. A method of incinerating waste, comprising:

providing an incinerator including a hollow main body with a front wall, a rear wall, a first side wall, a second side wall, a top wall, and a bottom wall, the front wall having a first opening and a second opening formed therein, the rear wall having at least one inlet aperture formed therein adjacent to the bottom wall, the first side wall and the second side wall each having at least one outlet aperture formed therein adjacent to the top wall, a door movably disposed on the front wall adjacent to the first opening, the door movable between an opened position and a closed position, the first opening uncovered by the door in the opened position, and the first opening covered by the door in the closed position, and a grate suspended inside of the hollow main body, the grate disposed between the first opening and the second opening in the front wall;

disposing the waste on the grate; and igniting the waste, whereby the waste is incinerated.

19. The method of claim 18, further comprising a step of one of i) orienting the hollow main body so that the at least one inlet aperture face a direction of a prevailing wind, and ii) attaching a blower to at least one inlet aperture to provide forced air to the hollow main body.

20. An incinerator, comprising:

a hollow main body with a front wall, a rear wall, a first side wall, a second side wall, a top wall, and a bottom wall, the front wall having a first opening and a second opening formed therein, the rear wall having at least one inlet aperture formed therein adjacent to the bottom wall, the first side wall and the second side wall each having at least one outlet aperture formed therein adjacent to the top wall, and the at least one inlet aperture defining a first aperture area and the at least one outlet aperture defining a second aperture area, the first aperture area being greater than the second aperture area, and each of the at least one inlet aperture and the at least one outlet aperture having a chamfered edge;

a latch rotatably affixed to the front wall of the main body adjacent to the first opening, wherein the latch has a wall connecting portion and an elongate handle portion, the elongate handle portion disposed on an elongate axis that is oriented transverse to the axis of rotation and defining a handle angle therebetween;

a door movably disposed on the front wall adjacent the first opening, the door movable between an opened position and a closed position, the first opening uncovered by the door in the opened position, and the first opening covered by the door in the closed position, the door having a wedge formed on an outer surface of the door, the wedge having an angled surface configured to cooperate with the latch disposed on the front wall to selectively secure the door in the closed position, wherein the door is disposed on a first plane and the angled surface of the wedge is disposed on a second plane, the first plane oriented transverse to the second plane and defining a wedge angle therebetween, the wedge angle being between about 5 degrees and about 25 degrees, and wherein the handle angle changes when the latch is in the latched position due to an outward bending of the elongate handle against the angled surface of the wedge, the outward bending providing a spring force to bias the door in the closed position; and a grate suspended in the hollow main body with a plurality of tack welds, the grate disposed between the first opening and the second opening in the front wall, the at least one inlet aperture being disposed above the grate.

* * * * *